US010966500B2

(12) United States Patent
Varriale

(10) Patent No.: US 10,966,500 B2
(45) **Date of Patent: *Apr. 6, 2021**

(54) MULTI-LINER BEARD SHAPING TEMPLATE

(71) Applicant: Danilo Varriale, Marietta, GA (US)

(72) Inventor: Danilo Varriale, Marietta, GA (US)

( * ) Notice: Subject to any disclaimer, the term of this patent is extended or adjusted under 35 U.S.C. 154(b) by 319 days.

This patent is subject to a terminal disclaimer.

(21) Appl. No.: 15/969,515

(22) Filed: May 2, 2018

(65) Prior Publication Data

US 2019/0335872 A1 Nov. 7, 2019

(51) Int. Cl.
*A45D 27/42* (2006.01)
*A45D 24/00* (2006.01)

(52) U.S. Cl.
CPC ..... *A45D 27/42* (2013.01); *A45D 24/00* (2013.01)

(58) Field of Classification Search
CPC ..... A45D 24/36; A45D 27/42; A41D 13/11; A41D 13/1107
USPC ..... 132/213, 213.1, 214, 215; 2/206; 30/537; D28/7, 9, 10, 25, 30, 44, 44.2
See application file for complete search history.

(56) References Cited

U.S. PATENT DOCUMENTS

D154,784 S * 8/1949 Lazar ..... D28/25
4,709,475 A * 12/1987 Phung ..... B26B 21/12 132/76.2
9,661,909 B2 * 5/2017 Brunett ..... A45D 24/02
D857,990 S * 8/2019 Varriale ..... D28/44.2
2012/0037176 A1 * 2/2012 Ito ..... A45D 24/02 132/200
2012/0234341 A1 * 9/2012 Kingery ..... A45D 27/42 132/214
2015/0020658 A1 * 1/2015 Eljaouhari ..... B26B 19/388 83/13
2016/0235180 A1 * 8/2016 Brunett ..... A45D 24/02
2017/0035178 A1 * 2/2017 Alvarez ..... A45D 27/42
2017/0355090 A1 * 12/2017 Spencer ..... B26B 21/527

OTHER PUBLICATIONS

"Amazon.Com: The Beard Black Beard Shaping & Styling Tool with Inbuilt Comb for Perfect Line up & Edging, Use with a Beard Trimmer or Razor to Style Your Beard & Facial Hair, Premium Quality Product: Health & Personal Care." Amazon, Amazon.com Inc., Mar. 11, 2017 (Year: 2017).*

* cited by examiner

*Primary Examiner* — Jacqueline T Johanas
*Assistant Examiner* — Thomas Drew Agger

(57) ABSTRACT

A multi-linear beard shaping template include a nose guide edge, a curved-cut edge, a first jawline edge, a comb section, a second jawline edge, and a step-cut edge. The curved-cut edge that enables a curved beard cut is terminally connected to the nose guide edge. The step-cut edge that enables a step beard cut is terminally connected to the nose guide edge, opposite of the curved-cut edge. The first jawline edge is terminally connected to the curved-cut edge, opposite of the nose guide edge. The second jawline edge is terminally connected to the step-cut edge, opposite of the nose guide edge. The first and second jawline edges and the nose guide provide symmetricity for different types of beard cuts. The comb section is terminally connected to the first jawline edge and the second jawline edge as the comb section and the nose guide are oriented opposite of each other.

9 Claims, 7 Drawing Sheets

MULTI-LINER BEARD SHAPING TEMPLATE

FIELD OF THE INVENTION

The present invention relates generally to a beard shaping tool. More specifically, the present invention is a multi-liner beard shaping template that enables an individual to precisely cut multiple beard styles in the comfort of their home.

BACKGROUND OF THE INVENTION

When an individual need to edge up the beard line, that is usually done by a professional stylist or a barber as most individuals are not capable or cutting their own beard. Often time, going to a professional stylist or a barber requires time and money with respect to an appointment time and a service fee. However, if the individual is pressed with time, making an appointment won't be a solution. Due to these reasons, many individuals try to cut their own beard and often fail due to lack of practice, skills, or limited beard cutting tools.

It is therefore an objective of the present invention to produce a multi-linear beard shaping template that allows an individual to attain a perfect edge for beard lines through multiple edges of the shaping template. More specifically, the present invention enables the users to shape their beard into symmetric step edges, symmetric curved edges, symmetric neckline edges, and symmetrical goatee edges. The present invention also provides a plurality of symmetrical indicators that functions as measuring units for perfectly balance sideburns. The present invention also provides an integrated comb so that the users can eliminate the necessity of an additional comb. Furthermore, the present invention is formed as a transparent body to provide unobstructed view of the user during the lining up of the beard lines.

DETAIL DESCRIPTIONS OF THE INVENTION

All illustrations of the drawings are for the purpose of describing selected versions of the present invention and are not intended to limit the scope of the present invention.

The present invention is a multi-linear beard shaping template that allows an individual to attain a perfect beard line with respect to multiple beard styles. More specifically, the present invention is utilized to trace the outline of a specific beard style so that shaving tools such as shavers, trimmers, clippers, scissors or blade, and straight razors can be used to cut the specific beard style. For example, the present invention can be used to symmetrically cut a curved or straight goatee, curved or straight beard lines on cheeks and neckline, curved or straight sideburns, beard jawlines, and any other types of similar edge lines. In reference to FIG. 1, the present invention comprises a main body 1 that is generally formed into a T-shaped body. The main body 1 functions as the template so that the users are able to position the present invention with respect to user's cheek area or neck area to cut aforementioned edge lines. In order to provide an unobstructed view of the beard line, the main body 1 is formed as a transparent body so that the user can easily and quickly trace the beard line.

Figure 1:
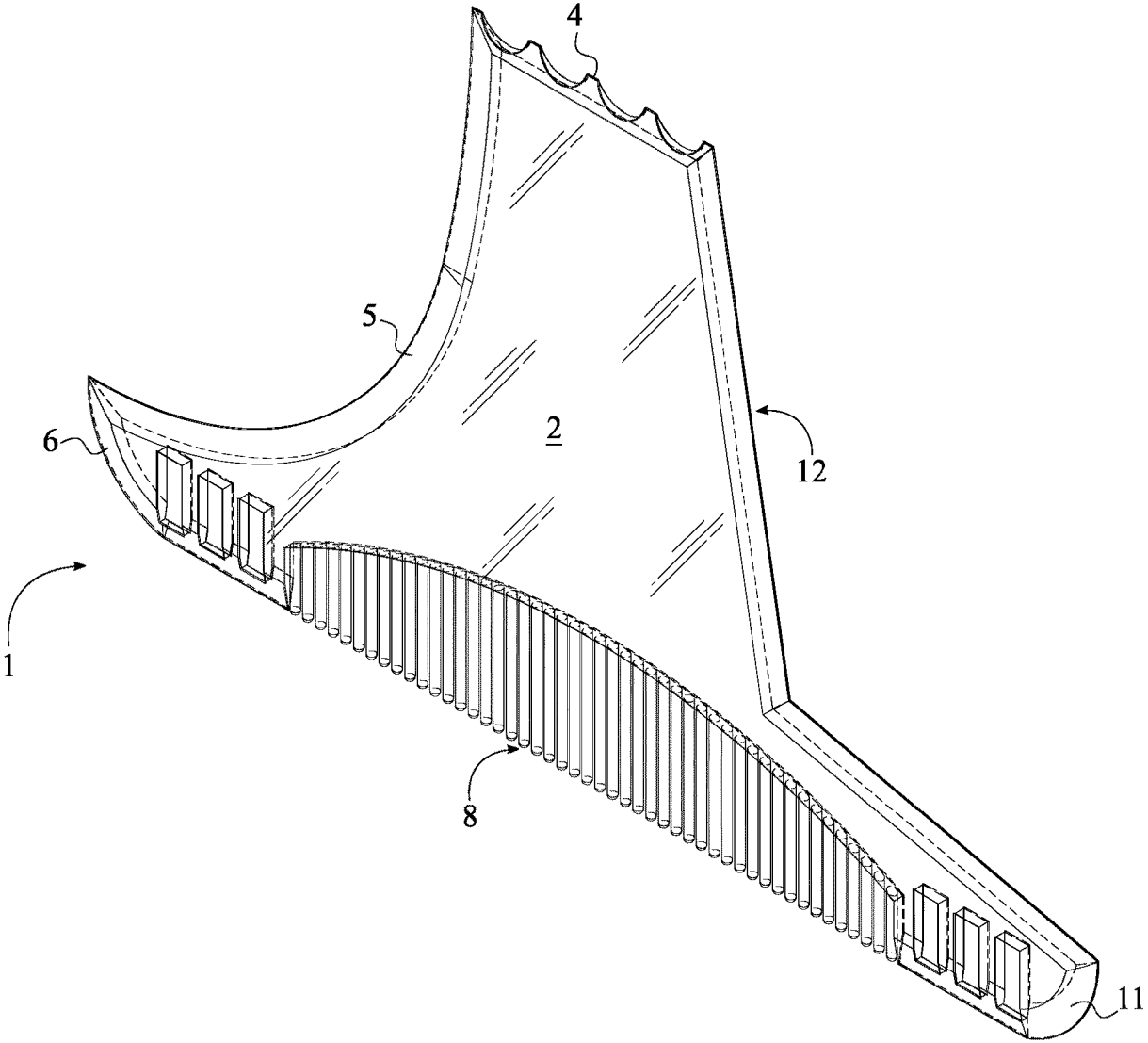
FIG. 1 is a perspective view of the present invention.
Figure 7:
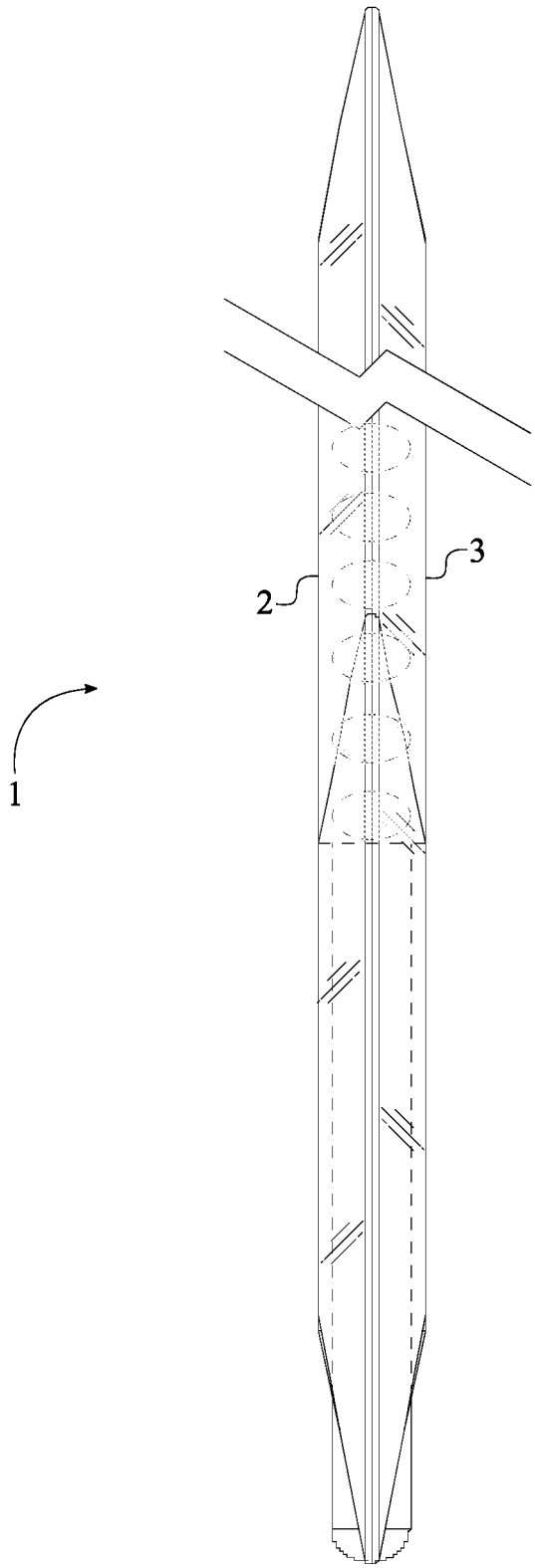
FIG. 7 is a side view of the present invention, showing the tapering edge from the front surface and the rear surface.

In reference to FIGS. 1 and 7, the main body 1 comprises a front surface 2, a rear surface 3, a nose guide edge 4, a curved-cut edge 5, a first jawline edge 6, a comb section 8, a second jawline edge 11, and a step-cut edge 12. More specifically, the nose guide edge 4, the curved-cut edge 5, the first jawline edge 6, the comb section 8, the second jawline edge 11, and the step-cut edge 12 are perimetrically positioned around the main body 1 thus delineating outer edges of the main body 1.

Figure 4:
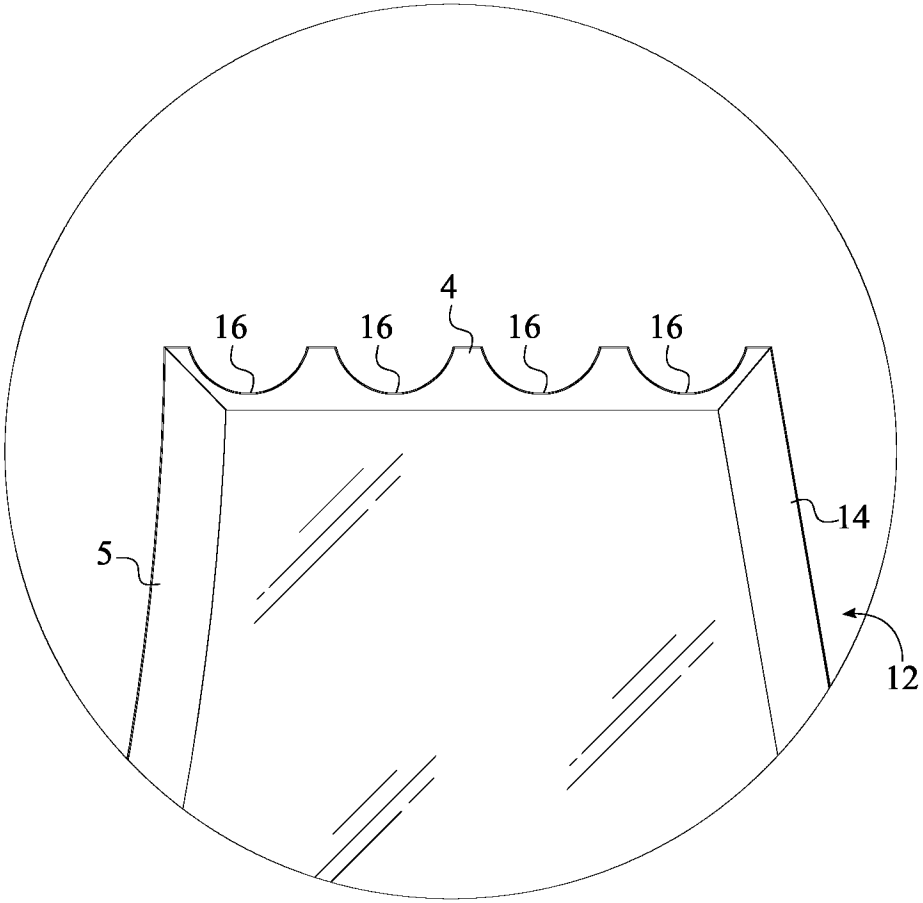
FIG. 4 is a detailed view of the nose guide edge of the present invention taken along section A of FIG. 3.

The nose guide edge 4 provides symmetrical goatee lines with respect to the left and right side of the user's face. In reference to FIG. 1-2, the curved-cut edge 5 is terminally connected to the nose guide edge 4. The step-cut edge 12 is terminally connected to the nose guide edge 4, opposite of the curved-cut edge 5. In other words, the nose guide edge 4 is positioned at the top end of the main body 1 and in between the curved-cut edge 5 and the step-cut edge 12. As a result, the nose guide edge 4 enables the user to cut a curved goatee line with the curved-cut edge 5 and a straight goatee line with the step-cut edge 12. In reference to FIG. 4, the present invention further comprises a plurality of indentations 16 that traverses into the nose guide edge 4. The plurality of indentations 16 enables the user to comfortably place the present invention under the nose as each of the plurality of indentations 16 is contoured to receive nasal columella and nasal alar side-wall. In order to provide different lateral movement across the nose, each of the plurality of indentations 16 is equally spaced apart from each other along the nose guide edge 4. In the preferred embodiment of the present invention, the plurality of indentations 16 is four indentations and each of the plurality of indentations 16 is formed into a semi-circular shape.

Figure 2:
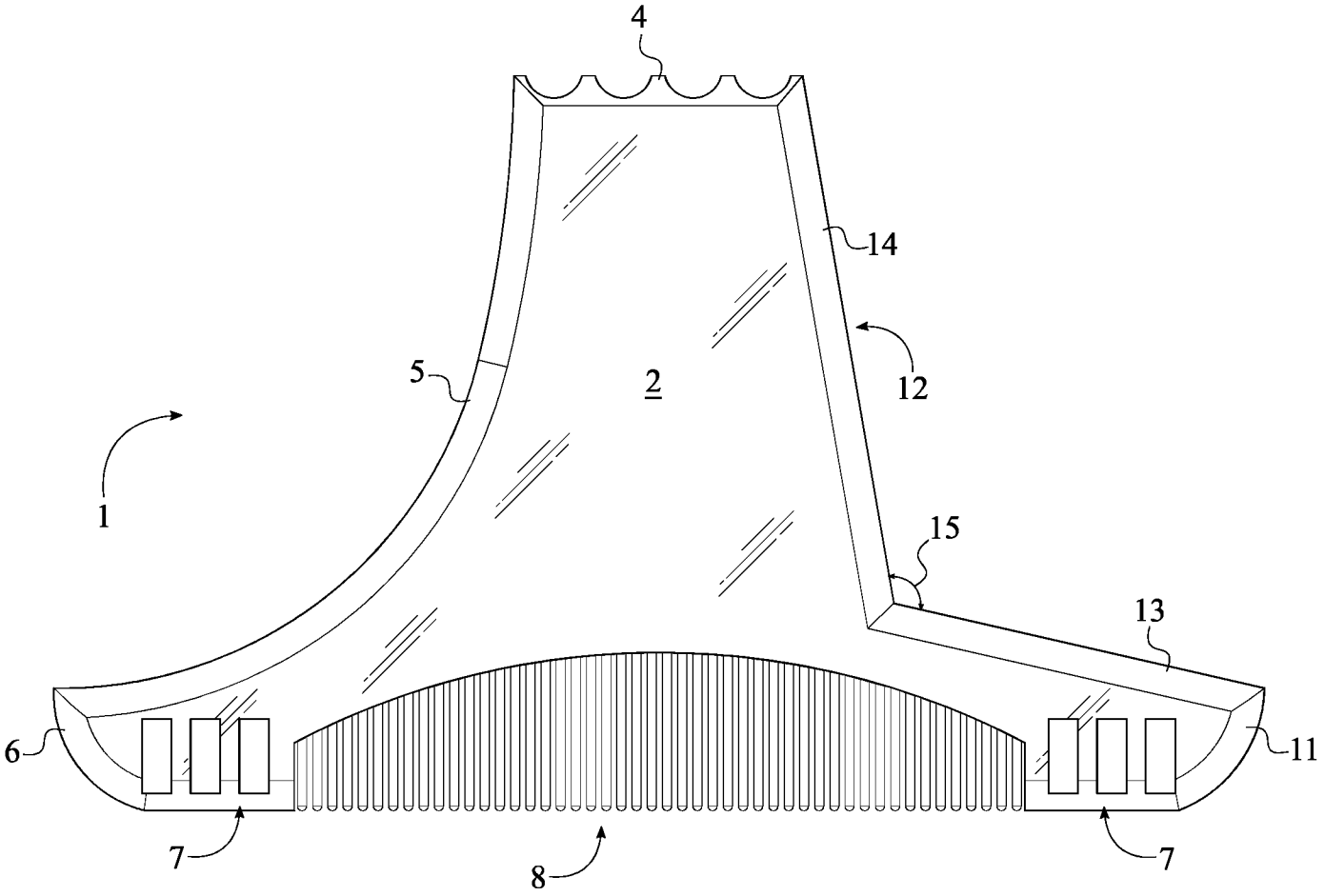
FIG. 2 is a front view of the present invention.

In reference to FIG. 1-2, the first jawline edge 6 is terminally connected to the curved-cut edge 5, opposite of the nose guide edge 4. The curved-cut edge 5 and the first jawline edge 6 allow the user to cut a curved beard line with respect to the left and right side of the user's face. The first jawline edge 6 enables the user to properly position the present invention so that the user is able to cut symmetrical curved beard lines. More specifically, the connection point between the curved-cut edge 5 and the first jawline edge 6 functions as a first outer point thus allowing the user to place the first outer point adjacent to the user's ear. As a result, the user is able to grasp the main body 1 about the step-cut edge 12 and cut the symmetrical curved beard lines with respect to the left and right side of the user's face.

In reference to FIG. 1-2, the second jawline edge 11 is terminally connected to the step-cut edge 12, opposite of the nose guide edge 4. The step-cut edge 12 and the second jawline edge 11 allow the user to cut a step-cut beard line with respect to the left and right side of the user's face. The second jawline edge 11 enables the user to properly position the present invention so that the user is able to cut symmetrical step-cut beard lines. More specifically, the connection point between the step-cut edge 12 and the second jawline edge 11 functions as a second outer point thus allowing the user to place the second outer point adjacent to the user's ear. As a result, the user is able to grasp the main body 1 about the curved-cut edge 5 and cut the symmetrical step-cut beard lines with respect to the left and right side of the user's face.

Furthermore, the step-cut edge 12 comprises a sideburn edge 13, a cheek edge 14, and an obtuse angle 15. In reference to FIG. 1-2, the sideburn edge 13 and the cheek edge 14 are terminally connected to each other with the obtuse angle 15. The sideburn edge 13 is terminally connected to the second jawline edge 11, opposite of the cheek edge 14. The cheek edge 14 is terminally connected to the nose guide edge 4, opposite of the sideburn edge 13. As a result, the sideburn edge 13 and the cheek edge 14 are able to provide a perfectly straight step-cut beard line within the present invention.

The comb section 8 functions as a comb and eliminates the necessity of an additional comb. In reference to FIG. 1-2, the comb section 8 is terminally connected to the first jawline edge 6 and the second jawline edge 11 in such a way that the comb section 8 and the nose guide edge 4 are oriented opposite of each other. Due to the placement of the comb section 8, the user can grasp the main body 1 about the curved-cut edge 5 and the step-cut edge 12 thus exposing the comb section 8 towards the beard.

Figure 3:
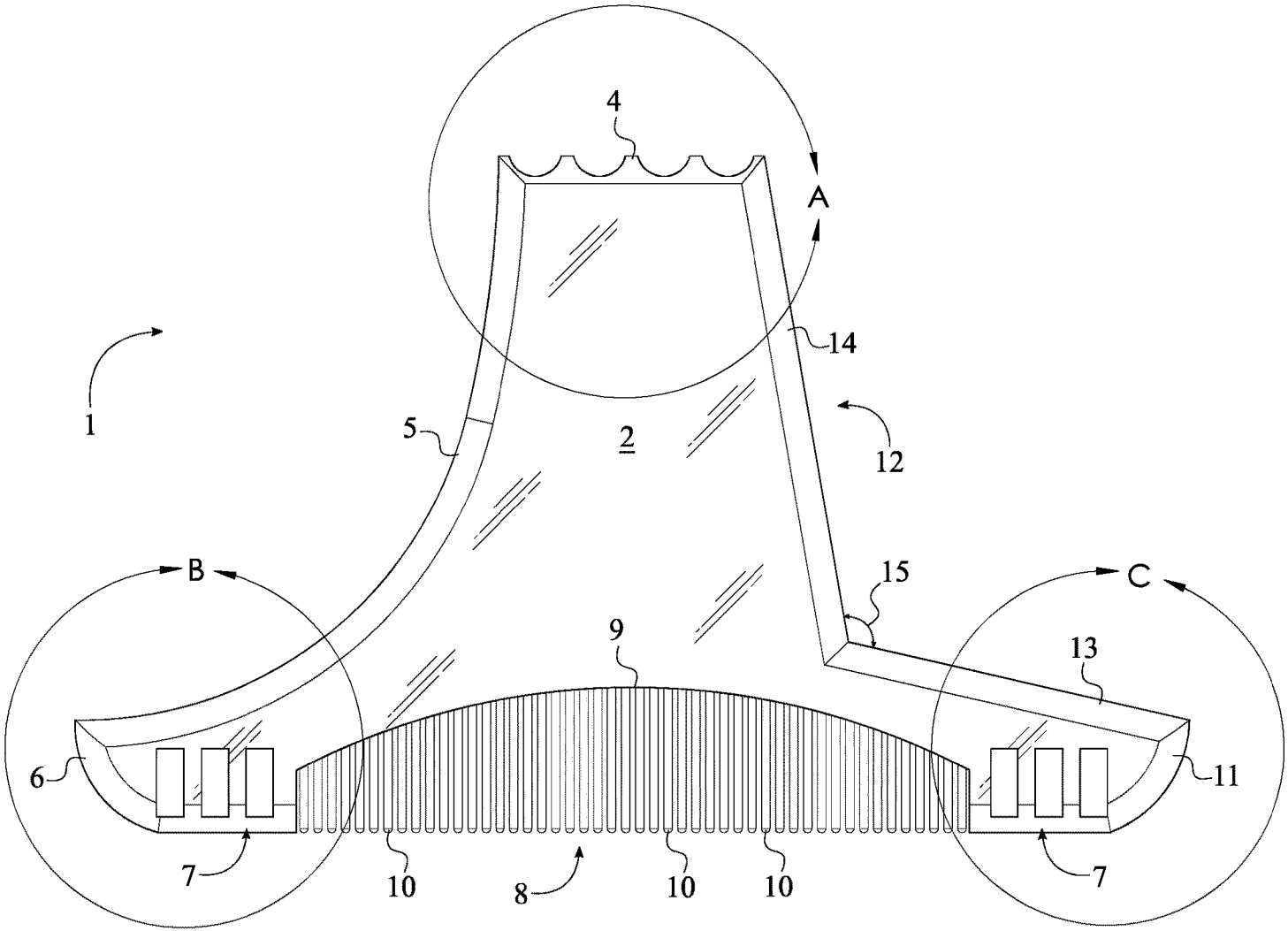
FIG. 3 is a front view of the present invention, showing the sections upon which detailed views are taken shown in FIGS. 4, 5, and 6.

Furthermore, the comb section 8 comprises a curvilinear edge 9 and a plurality of teeth 10 as show in FIG. 3. The curvilinear edge 9 is inwardly extended from the first jawline edge 6 and the second jawline edge 11. The plurality of teeth 10 is connected to along the curvilinear edge 9 as the curvilinear edge 9 provides a surface area for the plurality of teeth 10 to be connected. The plurality of teeth 10 is linearly extended to a lower end 7 of the first jawline edge 6 and the second jawline edge 11 thus completing the general shape of the comb section 8. Each of the plurality of teeth 10 is equally spaced apart from each other from the first jawline edge 6 to the second jawline edge 11 so that the user is able to get an even passthrough when the comb section 8 is utilized within the beard.

Figure 5:
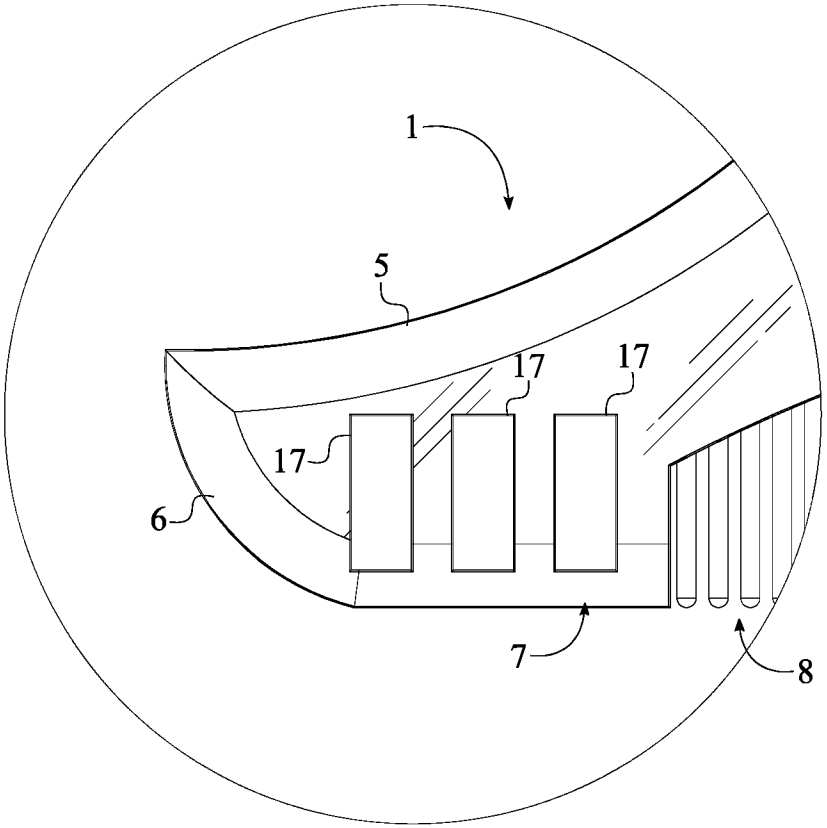
FIG. 5 is a detailed view of the plurality of first symmetrical indicators of the present invention taken along section B of FIG. 3.

In reference to FIG. 5, the present invention further comprises a plurality of first symmetrical indicators 17 to measure the length of the sideburn from the user's ear. More specifically, the plurality of first symmetrical indicators 17 traversing through the main body 1. The plurality of first symmetrical indicators 17 is positioned adjacent to the curved-cut edge 5 and the first jawline edge 6 as each of the plurality of first symmetrical indicators 17 is equally spaced apart from each other. In other words, each of the plurality of first symmetrical indicators 17 is linearly extended along the lower end 7 of the first jawline edge 6. In the preferred embodiment of the present invention, each of the plurality of first symmetrical indicators 17 is formed into a rectangular shape opening thus providing a clear view of the sideburn underneath.

Figure 6:
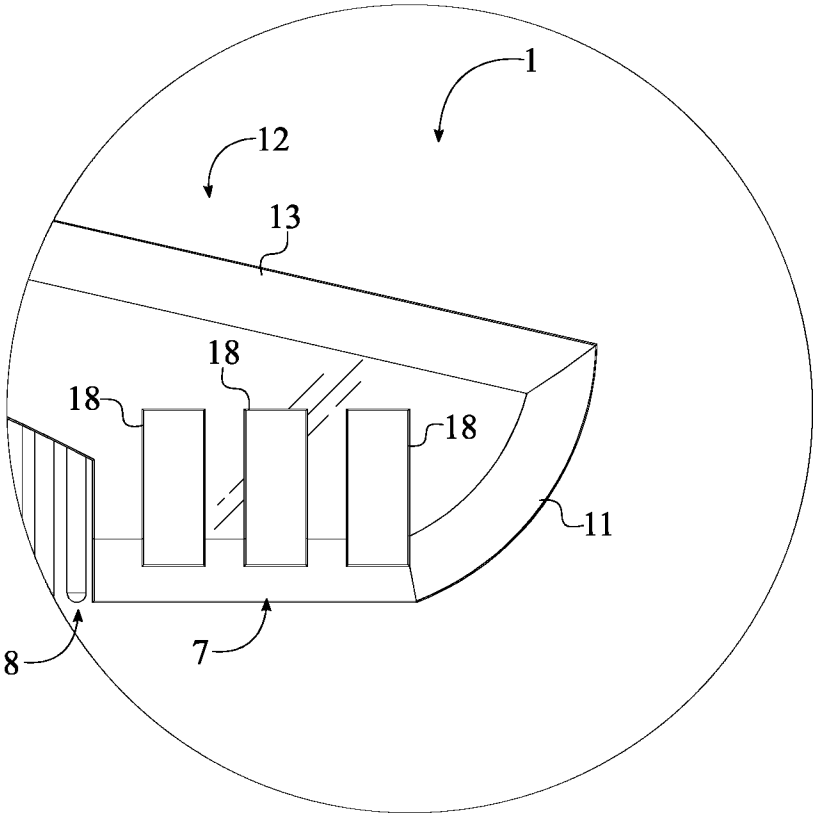
FIG. 6 is a detailed view of the plurality of second symmetrical indicators of the present invention taken along section C of FIG. 3.

In reference to FIG. 6, the present invention further comprises a plurality of second symmetrical indicators 18 to measure the length of the sideburn from the user's ear. More specifically, the plurality of second symmetrical indicators 18 traversing through the main body 1. The plurality of second symmetrical indicators 18 is positioned adjacent to the step-cut edge 12 and the second jawline edge 11 as each of the plurality of second symmetrical indicators 18 is equally spaced apart from each other. In other words, each of the plurality of second symmetrical indicators 18 is linearly extended along the lower end 7 of the second jawline edge 11. In the preferred embodiment of the present invention, each of the plurality of second symmetrical indicators 18 is formed into a rectangular shape opening thus providing clear of the sideburn.

The nose guide edge 4, the curved-cut edge 5, the first jawline edge 6, the second jawline edge 11, and the step-cut edge 12 are tapered from the front surface 2 and the rear surface 3 as shown in FIG. 7. The tapered edges provide a continuous thin edge around the main body 1 from the first jawline edge 6 to the first jawline edge 11 through the curved-cut edge 5, the nose guide edge 4, and the step-cut edge 12. The continuous thin edge, preferably 1 millimeter in thickness, enables the user to precisely and accurately cut the beard line as the utilized shaving tool smoothly glides over and along the tapered edge with respect to the curved-cut edge 5, the first jawline edge 6, the second jawline edge 11, and the step-cut edge 12.

Although the invention has been explained in relation to its preferred embodiment, it is to be understood that many other possible modifications and variations can be made without departing from the spirit and scope of the invention as hereinafter claimed.

What is claimed is:

1. A multi-linear beard shaping template comprises:

a main body;

the main body comprises a front surface, a rear surface, a nose guide edge, a curved-cut edge, a first jawline edge, a comb section, a second jawline edge, and a step-cut edge;

the curved-cut edge being terminally connected to the nose guide edge;

the step-cut edge being terminally connected to the nose guide edge, opposite of the curved-cut edge;

the first jawline edge being terminally connected to the curved-cut edge, opposite of the nose guide edge;

the second jawline edge being terminally connected to the step-cut edge, opposite of the nose guide edge;

the comb section being terminally connected to the first jawline edge and the second jawline edge;

the comb section and the nose guide edge being oriented opposite of each other;

a plurality of indentations;

the plurality of indentations traversing into the nose guide edge;

the plurality of indentations being equally spaced along the nose guide edge;

a plurality of first symmetrical indicators;

the plurality of first symmetrical indicators being positioned adjacent to the curved-cut edge and the first jawline edge;

the plurality of first symmetrical indicators traversing through the main body;

the plurality of first symmetrical indicators being equally spaced;

a plurality of second symmetrical indicators;

the plurality of second symmetrical indicators being positioned adjacent to the step-cut edge and the second jawline edge;

the plurality of second symmetrical indicators traversing through the main body;

the plurality of second symmetrical indicators being equally spaced; and the comb section being positioned in between the plurality of first symmetrical indicators and the plurality of second symmetrical indicators.

2. The multi-linear beard shaping template as claimed in claim 1, wherein:

the step-cut edge comprises a sideburn edge, a cheek edge, and an obtuse angle;

the sideburn edge and the cheek edge being terminally connected to each other with the obtuse angle;

the sideburn edge being terminally connected to the second jawline edge, opposite of the cheek edge; and the cheek edge being terminally connected to the nose guide edge, opposite of the sideburn edge.

3. The multi-linear beard shaping template as claimed in claim 1, wherein:

the comb section comprises a curvilinear edge and a plurality of teeth;

the curvilinear edge being inwardly extended from the first jawline edge and the second jawline edge;

the plurality of teeth being connected to the curvilinear edge;

the plurality of teeth being positioned along the curvilinear edge;

the plurality of teeth being linearly extended to a lower end of the first jawline edge and a lower end the second jawline edge; and the plurality of teeth being equally spaced apart.

4. The multi-linear beard shaping template as claimed in claim 1, wherein the nose guide edge is tapered from the front surface and the rear surface.

5. The multi-linear beard shaping template as claimed in claim 1, wherein the curved-cut edge is tapered from the front surface and the rear surface.

6. The multi-linear beard shaping template as claimed in claim 1, wherein the first jawline edge is tapered from the front surface and the rear surface.

7. The multi-linear beard shaping template as claimed in claim 1, wherein the second jawline edge is tapered from the front surface and the rear surface.

8. The multi-linear beard shaping template as claimed in claim 1, wherein the step-cut edge is tapered from the front surface and the rear surface.

9. The multi-linear beard shaping template as claimed in claim 1, wherein the main body is a transparent body.

* * * * *